US012414669B2

(12) United States Patent
Burggraf et al.

(10) Patent No.: US 12,414,669 B2
(45) Date of Patent: Sep. 16, 2025

(54) HOUSEHOLD DISHWASHER HAVING AT LEAST ONE AIR OUTLET

(71) Applicant: BSH Hausgeräte GmbH, Munich (DE)

(72) Inventors: Thomas Burggraf, Dillingen (DE); Klaus Steinle, Thierhaupten (DE); Alexander Almus, Bissingen (DE); Stephan Lutz, Zusamaltheim (DE); Armin Klaiber, Günzburg (DE); Martin Becker, Haunsheim (DE)

(73) Assignee: BSH Hausgeräte GmbH, Munich (DE)

( * ) Notice: Subject to any disclaimer, the term of this patent is extended or adjusted under 35 U.S.C. 154(b) by 208 days.

(21) Appl. No.: 18/024,522

(22) PCT Filed: Sep. 30, 2021

(86) PCT No.: PCT/EP2021/076972
§ 371 (c)(1),
(2) Date: Mar. 3, 2023

(87) PCT Pub. No.: WO2022/069650
PCT Pub. Date: Apr. 7, 2022

(65) Prior Publication Data

US 2023/0309782 A1 Oct. 5, 2023

(30) Foreign Application Priority Data

Sep. 30, 2020 (DE) ..... 102020212345.4

(51) Int. Cl.
*A47L 15/48* (2006.01)
*A47L 15/42* (2006.01)

(52) U.S. Cl.
CPC ..... *A47L 15/488* (2013.01); *A47L 15/4251* (2013.01); *A47L 15/483* (2013.01); (Continued)

(58) Field of Classification Search
CPC ..... A47L 15/486; A47L 15/488; A47L 15/00–508
See application file for complete search history.

(56) References Cited

U.S. PATENT DOCUMENTS 4,179,821 A * 12/1979 Herbst ..... A47L 15/4257 34/235
5,881,746 A 3/1999 Buser
(Continued)

FOREIGN PATENT DOCUMENTS

DE 1974430 U 12/1967
DE 29601313 U1 6/1996
(Continued)

OTHER PUBLICATIONS

National Search Report DE 102020212345.4 dated Jul. 12, 2021.
International Search Report PCT/EP2021/076972 dated Jan. 14, 2022.

*Primary Examiner* — Spencer E. Bell
(74) *Attorney, Agent, or Firm* — Michael E. Tschupp; Andre Pallapies; Brandon G. Braun

(57) ABSTRACT

A household dishwasher includes a dishwasher cavity for receiving items to be washed for treatment, and a structural unit sized to extend over at least half of a width of the household dishwasher. The structural unit includes an air outlet for blowing air out of the dishwasher cavity, an extensive slotted blow-out opening in an upper region of the structural unit, and a collecting tank in a lower region of the structural unit for collecting condensate.

24 Claims, 5 Drawing Sheets

(52) U.S. Cl.
CPC ..... *A47L 15/486* (2013.01); *A47L 2401/19* (2013.01); *A47L 2501/12* (2013.01)

(56) References Cited

U.S. PATENT DOCUMENTS

| | | | | |
|---|---|---|---|---|
| 8,313,583 | B2 | 11/2012 | May | |
| 9,888,829 | B1 | 2/2018 | Bongivengo | |
| 10,024,561 | B2 | 7/2018 | Olson | |
| 2010/0043250 | A1 | 2/2010 | Berends | |
| 2010/0083991 | A1 | 4/2010 | Tolf | |
| 2011/0126864 | A1* | 6/2011 | Kim | A47L 15/483 134/115 R |
| 2011/0241503 | A1 | 10/2011 | Simon | |
| 2013/0206186 | A1 | 8/2013 | Tang | |
| 2014/0170954 | A1* | 6/2014 | Hintz | A47L 15/48 454/251 |
| 2014/0238450 | A1 | 8/2014 | Bertram | |
| 2014/0360534 | A1* | 12/2014 | Olson | F24F 7/007 454/251 |
| 2016/0022116 | A1* | 1/2016 | Delellis | A47L 15/486 34/218 |
| 2017/0290489 | A1 | 10/2017 | Noriega | |
| 2018/0125329 | A1 | 5/2018 | Parmeggiani | |
| 2020/0100644 | A1 | 4/2020 | Kopera | |
| 2021/0100424 | A1* | 4/2021 | Tan | A47L 15/488 |

FOREIGN PATENT DOCUMENTS

| | | | | |
|---|---|---|---|---|
| DE | 19604370 | A1 | 6/1997 | |
| EP | 0378836 | A1 | 7/1990 | |
| EP | 0521815 | A1 | 1/1993 | |
| EP | 2682038 | A2 | 1/2014 | |
| EP | 3020319 | A1 * | 5/2016 | A47L 15/486 |
| EP | 3427628 | A1 | 1/2019 | |
| JP | 2018140243 | A | 9/2018 | |
| KR | 20130070278 | A1 | 6/2013 | |
| KR | 101308832 | B1 | 9/2013 | |
| KR | 101685357 | B1 | 12/2016 | |
| WO | 2015107474 | A1 | 7/2015 | |

* cited by examiner

HOUSEHOLD DISHWASHER HAVING AT LEAST ONE AIR OUTLET

CROSS-REFERENCES TO RELATED APPLICATIONS

This application is the U.S. National Stage of International Application No. PCT/EP2021/076972, filed Sep. 30, 2021, which designated the United States and has been published as International Publication No. WO 2022/069650 A1 and which claims the priority of German Patent Application, Serial No. 10 2020 212 345.4, filed Sep. 30, 2020, pursuant to 35 U.S.C. 119(a)-(d).

The contents of International Application No. PCT/EP2021/076972 and German Patent Application, Serial No. 10 2020 212 345.4 are incorporated herein by reference in their entireties as if fully set forth herein.

BACKGROUND OF THE INVENTION

The present invention relates to a household dishwasher having at least one air outlet for blowing in particular humid air out of a dishwasher cavity in which crockery, glasses, cutlery and similar items to be washed can be treated.

In such household dishwashers it is desirable to be able to remove the items to be washed from the dishwasher cavity, with the items to be washed being dried as completely as possible and without water stains. At the same time, it is intended that the amount of moisture affecting a floor on which the household dishwasher stands or the surrounding kitchen furniture is kept as small as possible.

For an effective drying result of crockery, glasses, cutlery and similar items which can be treated in a dishwasher cavity, it is desirable to be able to remove humid air from the dishwasher cavity. It is thus known to connect the dishwasher cavity to an air outlet which transports humid air from the dishwasher cavity into the external surroundings. Thus an air outlet is frequently located in the upper region of a front-side door or front door which can be opened and closed. Supplying air into this moving unit is thus relatively complex and expensive. Due to the arrangement at the top of the appliance there is also the risk of cabinets, countertops or other items of kitchen furniture located above the household dishwasher being damaged by the high level of escaping moisture.

The problem underlying the invention is to achieve an effective drying of items to be washed, with a minimal effect on the items of furniture, floors or other regions adjacent to the household dishwasher.

BRIEF SUMMARY OF THE INVENTION

The invention solves this problem by a household dishwasher having the features of the invention which can be implemented individually or in combination with one another.

In the embodiment as claimed in claim 1, since in the household dishwasher a structural unit comprising the at least one air outlet extends over at least half of the width of the household dishwasher and comprises an extensive slotted blow-out opening in the upper region thereof and a collecting tank for condensate in the lower region thereof, on the one hand, a distribution of the blown-out air, which is generally humid, through the slotted blow-out opening is ensured over a large region, so that large amounts of water contamination at certain points is avoided. On the other hand, the collecting tank in the lower region ensures that condensate can remain substantially in the structural unit and can run back down into the collecting tank, without escaping from the air outlet and without being able to wet the surrounding items of furniture or the floor as a result.

Additionally, since the air outlet extends as a slotted outlet over at least half of the width of the household dishwasher, in particular the bottom support thereof, a wide distribution is achieved of the escaping dishwasher-interior air which is laden with moisture and/or which contains water vapor. To this end, the slotted outlet preferably has a large slot width and a small slot height relative thereto. The dishwasher-interior air flowing out of the dishwasher interior of the dishwasher cavity is thus distributed to a plurality of outlet points along the width extent of the slotted outlet. A high, i.e. locally concentrated, volumetric flow of the dishwasher-interior air at certain points, as would be generated in a household dishwasher with only a single air outlet having an approximately circular cross-sectional passage surface at the outlet of this single air outlet, and which would be associated with a high ingress of moisture at certain points in the items of furniture, is avoided. In particular, the dishwasher-interior air which is humid and/or which contains water vapor, and which is blown out of the slotted outlet extending over at least half of the width of the household dishwasher, can be distributed sufficiently finely over a larger area outside the household dishwasher according to the invention that it can be mixed in an improved manner with the relatively drier ambient air. The moisture and/or water vapor which is contained, or which are contained, in the dishwasher-interior air, which is blown out over at least half of the width of the household dishwasher by means of the slotted outlet according to the invention, can be absorbed in an improved manner by the ambient air. Thus when viewed along the width extent of the slotted outlet, in each case, in particular, only a reduced volumetric flow of dishwasher-interior air which is humid and/or which contains water vapor escapes locally at each point of the slotted outlet, in comparison with a volumetric flow of dishwasher-interior air flowing in a concentrated manner out of a single, for example circular, air outlet which is defined locally or at certain points, into the surroundings at the installation site of the household dishwasher (with the same total throughput of dishwasher-interior air). A local dilution of the dishwasher-interior air coming from the dishwasher interior of the dishwasher cavity, and the moisture content contained therein, in the ambient air is ensured by the slotted outlet according to the invention. In this manner it is possible to reduce or even substantially avoid the condensation of moisture on the front face of the household dishwasher, in particular the front door thereof. In particular, it is substantially avoided that condensate droplets are able to combine together to form larger liquid droplets and that these droplets then run or drip down out of the air outlet onto the floor at the installation site of the household dishwasher. Additionally, the distribution of the blown-out dishwasher-interior air, which is produced by means of the slotted outlet, over at least half of the width of the household dishwasher, in particular the front door thereof, optionally enables the volumetric flow of the blown-out dishwasher-interior air for each outlet point of the outlet slot to be sufficiently small that the dishwasher-interior air, which is blown out locally and distributed over the width, can be barely or only insignificantly perceived by a user of the household dishwasher along the width extent of the outlet slot.

Expediently, the outlet cross-sectional passage surface is smaller, in particular substantially smaller, than the inlet cross-sectional passage surface of the air outlet according to the invention. This produces an increase in the flow rate of the dishwasher-interior air blown out of the slotted outlet into the surroundings, relative to the flow rate of the dishwasher-interior air upstream before it enters the slotted outlet. This further reduces the risk of an undesired collection of condensate and the resultant dripping of water on the outlet side of the slotted outlet.

In the embodiment according to claim 2, a modular flexible construction of the structural unit comprising the at least one air outlet is ensured. A high functionality and ability to collect condensed water is obtained by means of the functions achieved therein, namely ensuring a condensation region which rises upwardly and which extends in the width direction of the appliance as well as at least one blow-out opening extending therefrom to a front face of the household dishwasher, and an inlet opening on this structural unit leading into the condensation region at the rear. The structural unit can be positioned differently in the depth direction of the household dishwasher and can also be clad with different panels, in particular panels of variable heights, below the extensive blow-out opening.

In particular, the structural unit comprising the at least one air outlet is configured integrally with the blow-out opening and at least one inlet opening and a condensation region so that it can be easily mounted as a complete unit and is also inexpensive to manufacture.

In this case, it is particularly advantageous if the structural unit comprising the at least one air outlet is configured in one piece and is able to be produced inexpensively and rapidly, namely in an injection-molding process or the like.

If the air outlet is preferably at least 40 centimeters wide overall, a good distribution of the humid air is ensured with only a low probability that the water will drip out at certain points.

In particular, the air outlet is configured as a flat slotted outlet with a height-to-width ratio of less than 1:10, particularly advantageously of less than 1:20. In spite of the very low height, structurally and visually, a large discharge area can be achieved thereby.

For a high degree of mechanical stability and security against intervention, the air outlet can be divided into a plurality of partial slots which are aligned adjacent to one another, for example into two to three partial slots adjacent to one another, and which in each case comprise stiffening vertical webs as a stable separation from one another.

If the air outlet is arranged on the front face of the household dishwasher facing a user, the air which escapes there and which is frequently laden with moisture can be distributed rapidly and over a large area in the surrounding space.

The air outlet is arranged with a minimal installation space requirement, such that the structural unit comprising the air outlet is arranged entirely at the lower end of the front face of the household dishwasher, in particular on the front face of a plinth. Generally, in any case front cladding can be attached here. Since the structural unit is configured to be very flat—preferably less than 5 centimeters—outside the extensive blow-out opening and a rear connecting flange for the air inlet, only very little space is required in the depth direction.

Both for the air distribution and for a straight continuous design it is advantageous if the structural unit preferably extends over the entire width of the front face of the household dishwasher.

Moreover, the air outlet can protrude forward relative to the remaining outer walls of the structural unit toward the front face such that the blow-out opening faces further forward, in particular by several centimeters, than the outer walls of the condensation region. This has proved advantageous, in particular with a recessed plinth, since the air outlet then takes up an otherwise unused space at the upper end of the plinth below the door. As the blow-out opening is located at the top at the upper end of the structural unit, condensed water can also flow back down into the structural unit so that the risk of dripping is further minimized.

With its—preferably approximately horizontal—projection oriented to the front, the air outlet advantageously can be arranged, in particular connected, to the upper edge of a plinth board or a plinth strip or kick strip. If the structural unit according to the invention is fully mounted on the plinth board according to this advantageous embodiment, its air outlet is preferably located on the upper edge of the plinth board, with the lower edge of its projection oriented to the front; the preferably vertically extending condensation region thereof is arranged behind the plinth board. Irrespective of the height of the plinth board or the plinth strip, the structural unit can be positioned thereon in a manner which is simple and easy to mount such that it is always ensured that the blow-out opening is arranged above the upper edge of the plinth board and as a result the air can blow freely out of the dishwasher interior. It is thus always avoided that the blow-out path of the air from the blow-out opening of the air outlet is shielded by a plinth board being placed in front of the structural unit.

Both for the uncomplicated design and for the uniformity of the air output over the width, the blow-out opening can advantageously have, in particular, a uniform height over its width extent.

The condensation region can also have, in particular, a uniform depth, wherein expediently a panel can be arranged in front of said condensation region toward the front face, in order to achieve a uniform design relative to further items of kitchen furniture.

A very effective avoidance of dripping water is achieved when the blow-out opening is formed as a very narrow gap between an upper lip and a lower lip, and the lower lip rises steadily from the condensation region to the blow-out opening. Then water produced over the entire region up to the blow-out opening can run reliably back into the structural unit and the collecting tank, without escaping into the surroundings. In the idling phases of the household dishwasher, any potentially collected water can then evaporate there.

In such an embodiment it is also very effective if the upper lip on its downwardly facing side has a drip edge which is located above the lower lip. Water formed on this drip edge then lands reliably on the lower lip when dripping thereon and can run back without escaping to the outside. Preferably, to this end the lower lip protrudes further than the upper lip in the direction of the front face of the household dishwasher.

In order to be able to transport humid air out of the dishwasher cavity to the air outlet, an air channel, in particular several tens of centimeters long, which originates from the dishwasher cavity and which can be connected in a flexible manner to the inlet of the structural unit, can be arranged upstream of the structural unit. The structural unit thus does not have to be precisely located in the depth direction but can be mounted in a flexible manner. A retrofitting of existing systems can also be possible.

To this end, in particular, the air channel can have a variable length up to the connection at the inlet of the structural unit and, for example, form a folding bellows-type hose at least in some regions.

A high level of efficiency can be achieved if the air outlet can be activated by at least one conveying member, such as a fan wheel, which as a result supplies the air from the dishwasher cavity to the air channel.

In a very advantageous manner, an air channel, in particular several tens of centimeters long, which originates from the dishwasher cavity is arranged upstream of the slotted air outlet. Thus to a large extent the condensation process can take place, with the moisture already distributed, in this long air channel.

A high level of efficiency can be achieved if the slotted air outlet can be activated by at least one air conveying member such as a fan wheel, i.e. can be acted upon by dishwasher-interior air from the dishwasher interior of the dishwasher cavity. The air conveying member is fluidically connected upstream, preferably via the air channel, to at least one air outlet opening of the dishwasher cavity or to at least one air outlet opening of the internal door of the front door. Preferably, downstream of the air conveying member an exhaust air channel or blow-out channel leads to the slotted air outlet. If the air conveying member is activated, i.e. switched on, dishwasher-interior air from the dishwasher interior of the dishwasher cavity is suctioned thereby via the upstream air channel to the air conveying member and then blown thereby through the downstream exhaust air channel to the air outlet. The air conveying member can preferably be arranged in the lower region of the household dishwasher, in the depth direction behind the air outlet. The fan wheel or the like can then be located at approximately the same height as the air outlet itself and can be arranged in a space-saving manner in the plinth or bottom support of the household dishwasher. To this end, in a very advantageous manner, the air channel starts within the upper 50%, in particular 30%, of the height of the dishwasher cavity in one of its walls, whereby a long path is formed for potential condensation. The air channel can be, in particular, at least 40 centimeters long. It is also advantageous if the air channel initially runs upwardly from the start of the air channel at the air outlet opening in the wall of the dishwasher cavity or the front door, so that any potentially formed condensed water can run back into the dishwasher cavity and does not remain in the air channel.

A high level of efficiency can be achieved if the air outlet can be activated by at least one air conveying member such as a fan wheel, i.e. can be acted upon by dishwasher-interior air from the dishwasher interior of the dishwasher cavity. The air conveying member is fluidically connected upstream, preferably via an air channel, to at least one air outlet opening of the dishwasher cavity or to at least one air outlet opening of the internal door of the front door. Preferably, downstream of the air conveying member an exhaust air channel leads to the air outlet. If the air conveying member is activated, i.e. switched on, dishwasher-interior air from the dishwasher interior of the dishwasher cavity is suctioned thereby via the upstream air channel to the air conveying member and then blown thereby through the downstream exhaust air channel to the air outlet. The air conveying member can preferably be arranged in the lower region of the household dishwasher, in the depth direction behind the air outlet. The fan wheel or the like can then preferably be located at approximately the same height as the air outlet itself and can be arranged in a space-saving manner in the plinth or bottom support of the household dishwasher. To this end, in a very advantageous manner, the air channel starts within the upper 50%, in particular 30%, of the height of the dishwasher cavity in one of its walls, whereby a long path is formed for potential condensation. The air channel can be, in particular, at least 40 centimeters long. It is also advantageous if the air channel initially runs upwardly from the start of the air channel at the air outlet opening in the wall of the dishwasher cavity or the front door, so that any potentially formed condensed water can run back into the dishwasher cavity and does not remain in the air channel.

Particularly advantageously and separately claimed, a blow-out channel or exhaust air channel extends between the at least one (air) conveying member and the air outlet, the blow-out channel or exhaust air channel being designed with a reduced cross section relative to the air channel which leads from the dishwasher cavity, in particular from an air outlet opening in a wall, in particular a side wall, of the dishwasher cavity or in an internal door wall of the front door, to the conveying member. By the reduced cross section the flow rate of the dishwasher-interior air suctioned by the conveying member from the dishwasher interior of the dishwasher cavity in the blow-out channel is increased relative to the flow rate of the dishwasher-interior air in the air channel upstream of the conveying member so that only a little condensation is produced downstream of the conveying member in the vicinity of the air outlet and thus here the water formation and the risk of water dripping from the air outlet is minimized.

An advantageous development of the invention provides that the fan wheel or a similar conveying member can be activated in a clocked manner, even over a period of several days. It can also be activated by detecting the level of moisture in the dishwasher cavity. The household dishwasher can also serve as a store for crockery, glasses, cutlery and the like and also subsequently dry, repeatedly in phases over several days, these articles which have been previously washed.

The dishwasher-interior air is not only able to be blown out of the household dishwasher according to the invention via the slotted outlet thereof during the drying cycle of the washing cycle of at least one dishwashing program to be carried out, but if required also at a later time after the end of the drying cycle of the washing cycle, during one or more subsequent drying cycles for subsequently drying the items to be washed which are stored in the dishwasher cavity. Such a subsequent drying can be desired if the door is not opened by the user or an automatic door opening system immediately after the end of the drying cycle of the washing cycle of the respective dishwashing program to be carried out, but still remains closed for a lengthy time period, in particular for at least 6 hours and up to several days, such as for example for up to 96 hours. This subsequent storage of items to be washed in the dishwasher interior of the dishwasher cavity with the door closed, after the end of the drying phase of a dishwashing program carried out, is denoted as the "storage function". In order to keep the items to be washed in the dishwasher interior dry or to avoid the situation where the items to be washed become wet again, from time to time at least one air conveying member is activated, in each case for a specific time period, in order to carry out in the dishwasher interior a subsequent drying of the items to be washed or to avoid the situation where the items to be washed become substantially wet again, by replacing the dishwasher-interior air with ambient air, and then deactivating the air conveying member again.

Further developments of the invention are set forth in the dependent claims.

The advantageous embodiments and developments of the invention described above and/or set forth in the dependent claims can be used individually or in any combination with one another—apart from, for example, in cases where there are clear dependencies or incompatible alternatives.

The invention and its advantageous embodiments and developments as well as the advantages thereof are described hereinafter in more detail with reference to the drawings showing exemplary embodiments.

BRIEF DESCRIPTION OF THE DRAWINGS

In each case in a schematic basic sketch.

DETAILED DESCRIPTION OF EXEMPLARY EMBODIMENTS OF THE PRESENT INVENTION

In FIGS. 1 to 5 parts which correspond to one another are provided with the same reference signs. Only those constituent parts of a household dishwasher which are necessary for understanding the invention are provided and described with reference signs.

Figure 1:
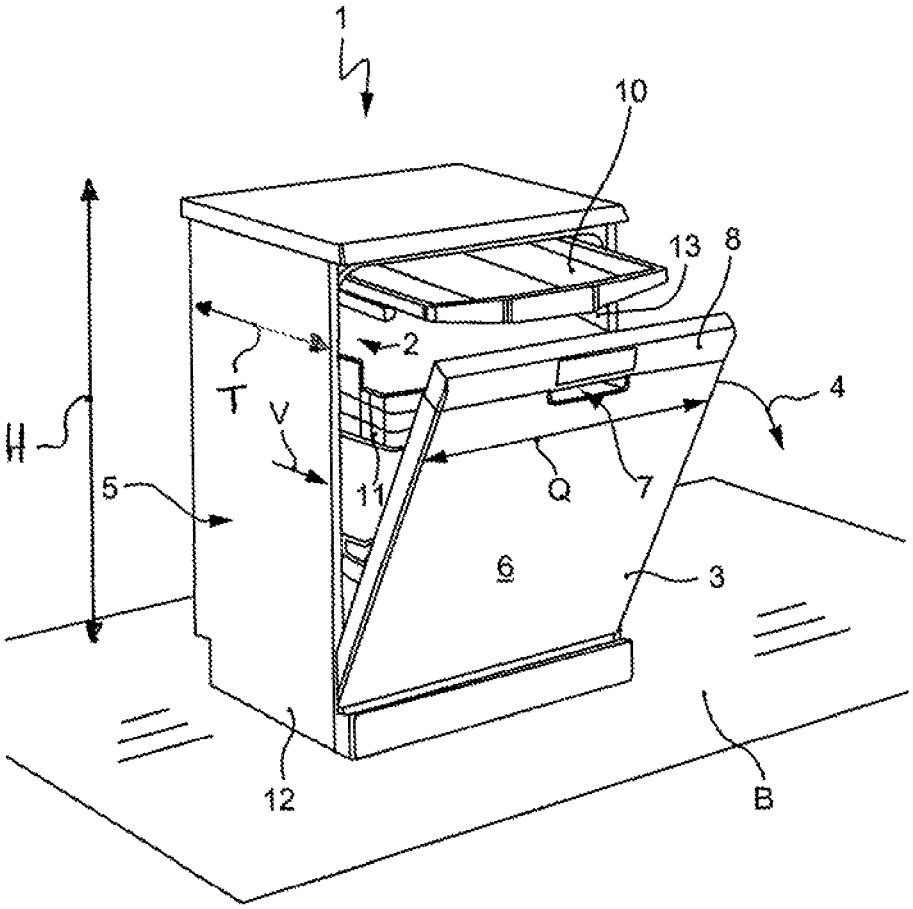
FIG. 1 shows a schematic perspective view obliquely from the front of an exemplary household dishwasher with a plinth in the lower region with a partially open door.

The household appliance 1 shown schematically in FIG. 1 is in this case a dishwasher 1 and namely a household dishwasher. Other household appliances 1 with a drying function for the items to be treated are also relevant in principle for a configuration according to the invention.

The household dishwasher 1, which is described hereinafter according to FIG. 1, has a dishwasher cavity 2 for receiving items to be washed and to be treated, such as crockery, pots, cutlery, glasses, cooking utensils, and the like, as a constituent part of an appliance body 5 which is partially open or closed to the outside. The items to be washed can be held, for example, in crockery baskets 11 and/or a cutlery drawer 10 and so-called washing liquor can be applied thereto. "Washing liquor" is understood to mean in this case fresh water or, in particular, water circulating during operation with or without detergent and/or rinse aid and/or drying agent. In particular, the washing liquor has passed through an ion exchanger for softening. The washing liquor can additionally be subjected to a greater or lesser extent to contamination from the ongoing operation. The dishwasher cavity 2 can have an at least substantially rectangular footprint with a front face V facing a user in the operating position. This front face V can form at the same time a part of a kitchen front consisting of items of kitchen furniture standing adjacent to one another or in a stand-alone appliance can be unrelated to other items of furniture.

The dishwasher cavity 2 can be closed, in particular, on this front face V by a front door or flap 3. This door 3 is shown in FIG. 1 in the partially open position and thus obliquely to the vertical. In its closed position, however, the door stands upright and, according to the drawing, for the opening thereof is able to be pivoted open toward the front about a lower horizontal axis and downwardly in the direction of the arrow 4 so that it is located at least approximately horizontally in the fully open position.

On the vertical outer face and front face V facing the user, in the closed position thereof, the door 3 can be provided with a decorative panel 6 in order to achieve thereby a visual and/or haptic enhancement and/or an adaptation to the surrounding items of kitchen furniture.

The household dishwasher is configured here as a stand-alone appliance or as a so-called partially integrated or even fully integrated appliance. In the last-mentioned case the appliance body 5 can also be substantially terminated by the outer walls of the dishwasher cavity 2. A housing outwardly surrounding the dishwasher cavity can then be dispensed with. A plinth 12 can be located in the lower region of the household dishwasher for receiving, in particular, functional elements, such as for example a pump for circulating the washing liquor and an air outlet 14 which is described in more detail below.

In the exemplary embodiment according to the drawing, the movable door 3 is assigned in its upper region a control panel 8 which extends in the transverse direction Q of the household dishwasher and which can comprise an access opening 7 which is accessible from the front face V for manually opening and/or closing the door 3. In the transverse direction Q the household dishwasher frequently has an extent of 45, 50 or 60 centimeters. In the depth direction T from the front face V to the rear, the extent is also frequently approximately 60 centimeters. The values are not mandatory.

The dishwasher cavity 2 is defined over the periphery, when the front door or flap 3 is closed, by a total of three fixed vertical walls 13 and two horizontal walls 13, one thereof (above) forming a ceiling and another (below) forming a bottom of the dishwasher cavity 2. A left-hand upright side wall 13 to the left and a right-hand upright side wall 13 to the right in the transverse direction Q adjoin the front face V facing the user.

The wall 13 forming the bottom of the dishwasher cavity 2 and defining this dishwasher cavity substantially downwardly is located approximately horizontally above the plinth 12, i.e. parallel to an external floor B on which the household dishwasher 1 can stand. A higher installation, for example approximately level with a countertop, is also possible, in particular within a cabinet. The lower edge of the household dishwasher 1 is then located in the installed position ca. 70 to 110 centimeters above the floor.

The household dishwasher 1 is provided with at least one air outlet 14 for blowing, in particular humid, air out of the dishwasher cavity 2. This air outlet is a constituent part of a structural unit 15 which is shown by way of example in FIG. 2 as a whole. The structural unit 15, comprising the at least one air outlet 14, extends over at least half of the width Q of the household dishwasher 1. According to the drawing, the structural unit 15 preferably extends over the entire width Q of the household dishwasher.

Amongst other things, the structural unit 15 comprises in its upper region an extensive slotted blow-out opening 16 and in its lower region a collecting tank 17 for condensate. In the mounted position the blow-out opening faces toward the front face V of the household dishwasher 1 and protrudes by several centimeters relative to a front wall 18 of a condensation region 19. An inlet opening 20 leading into the condensation region 19 is provided on the rear face located opposite the blow-out opening 14, the inlet opening by way of example comprising here a protruding flange for pushing on a hose. The structural unit 15 comprises the aforementioned functional parts 14, 16, 17, 18, 19, 20 and optionally 21 in an integral manner. The structural unit can be configured in a modular manner and is able to be mounted preassembled.

In the structural unit 15 comprising the at least one air outlet 14, the condensation region 19 is configured as an internal hollow space which rises upwardly and which extends substantially in the transverse direction Q of the appliance 1. In the depth direction T, however, in order to save space the extent is very small and typically is only approximately one to three centimeters. The front wall of the condensation region 19, which in the mounted position is in contact with room air, can from a cool surface and, for example, can be provided with cooling ribs 21. In particular, the front wall 18 comprises a material having a high thermal capacity. The front wall can be cooled simply by the ambient air, by water or other materials. The blow-out opening 16 extending therefrom to the front face V of the household dishwasher 1 and an inlet opening 20 leading into the condensation region at the rear are encompassed in an integral manner. The lower collecting tank 17 can also be an integral constituent part of the structural unit 15 and can preferably extend over the entire width of the condensation region 19 in order to collect water produced there in a reliable manner.

The structural unit 15 comprising the air outlet 14 can be configured, in particular, in one piece, for example from plastics.

In particular, to this end the—one-piece or multi-piece—air outlet 14 is at least 40 centimeters wide overall. The air outlet is configured according to FIG. 2 as a flat slotted outlet with a height-to-width ratio of less than 1:10, in particular of less than 1:20. Thus, for example, with an air outlet 4 which is 40 centimeters wide, the height thereof in the vertical direction H is preferably less than ca. 2 centimeters.

As already indicated above, the air outlet 14 can be divided into a plurality of partial slots which are aligned adjacent to one another. These partial slots do not all have to be of the same length. It is important that overall an air outlet 14 is provided which extends over the width and which permits a high air throughput, in order to achieve in this manner a wide distribution of the moisture contained in the air.

Figure 5:
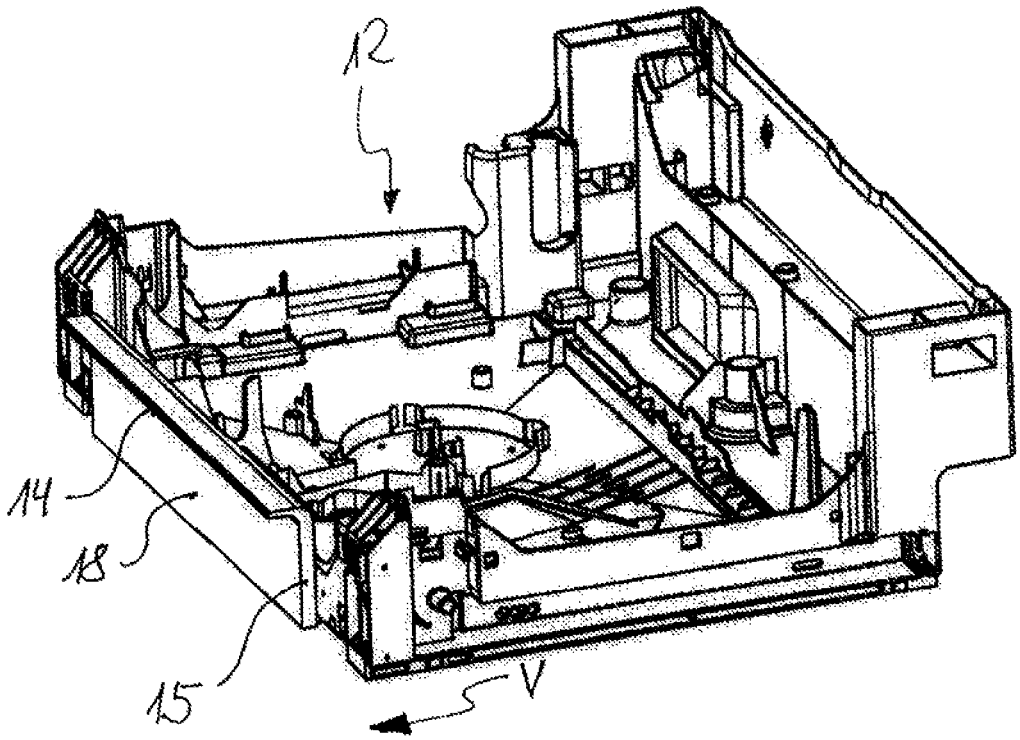
FIG. 5 shows a typical plinth of a household dishwasher, in this case with a structural unit which is mounted on the front face and which can also be clad with a front panel.

As already indicated above and as can be seen in FIG. 5, for example, the air outlet 14 is advantageously arranged on the front face V of the household dishwasher 1 facing the user. The air outlet can thus blow out air in the space in front of the household dishwasher 1 and effectively distribute the moisture so that the humid air does not disappear inside fitted furniture and potentially cause damage therein.

The air outlet 14 is preferably arranged according to the drawing such that the structural unit 15 comprising the air outlet is arranged entirely at the lower end of the front face V of the household dishwasher 1. In particular, the structural unit 15 is fixed at the front end of the plinth 12 and in turn can be clad toward the front face V with a front panel.

Both for a uniform design and also for wide distribution of moisture it is advantageous if the structural unit 15 preferably extends over the entire width Q of the front face V of the household dishwasher 1.

The air outlet 14 is arranged at the upper end of the structural unit 15. The air outlet protrudes forward relative to the remaining outer walls of the structural unit toward the front face V such that the blow-out opening 16 faces further forward, in particular by several centimeters, than the front outer wall 18 of the condensation region 19. To this end, the internal hollow space initially extends from the condensation region 19 at least approximately vertically upwards and then transitions at the top into the horizontally located air outlet 14, as can be derived for example from FIGS. 2 and 3.

The blow-out opening 16 preferably has a uniform height over its width extent, so that the fluid distribution is also uniform. Internal air guiding devices—not shown here—can also ensure that even regions of the air outlet 14 which are located furthest to the outside in the transverse direction Q are uniformly supplied with air.

Figure 2:
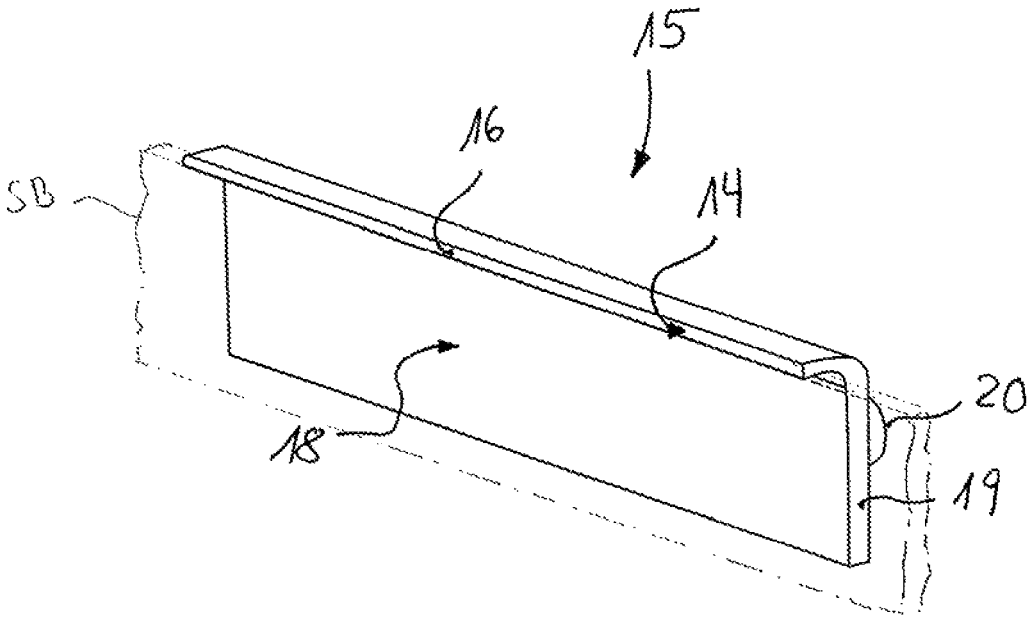
FIG. 2 shows a schematic individual partial view of a structural unit with a blow-out opening, a condensation region and a rear inlet for an air channel.
Figure 3:
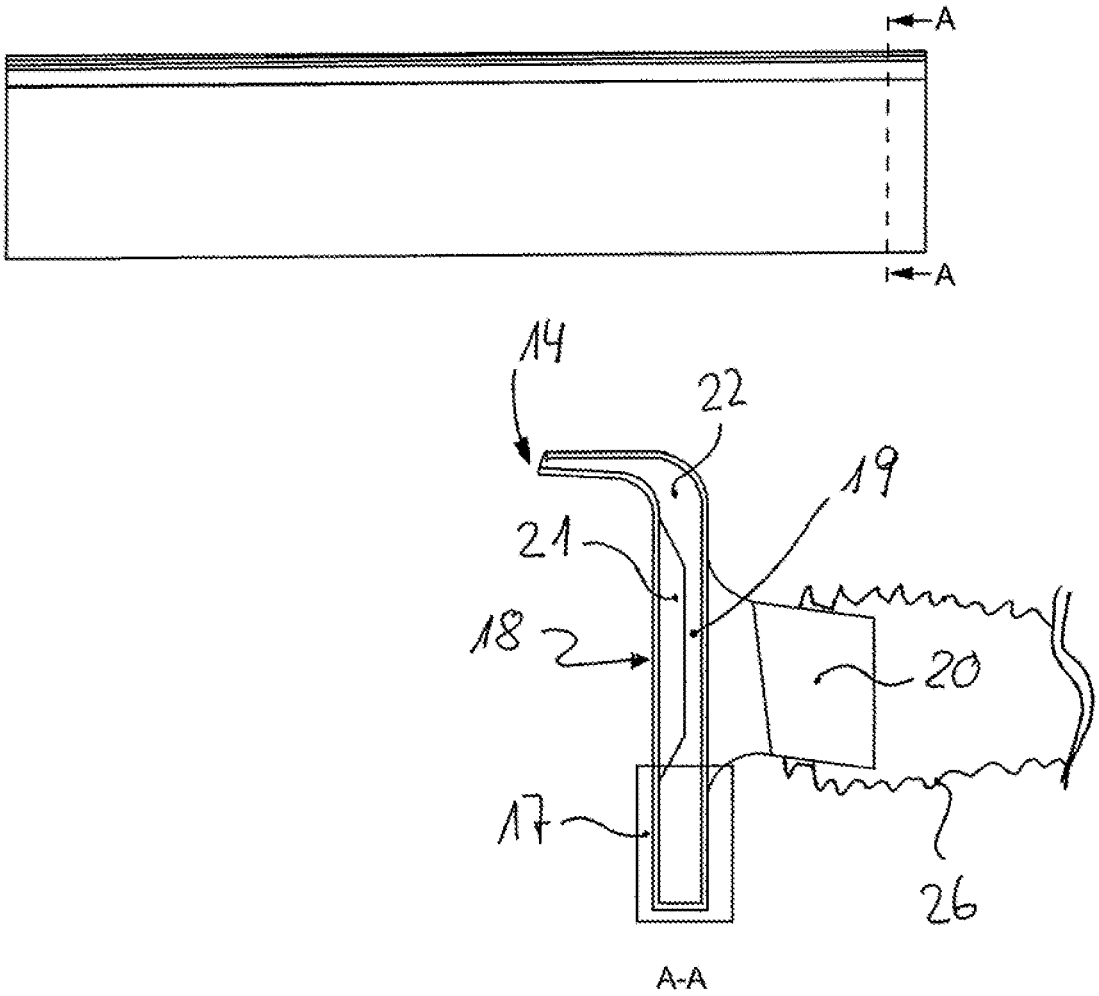
FIG. 3 shows a view of the structural unit according to FIG. 2 from the front face (upper illustration) and a section along the line A-A in the upper illustration.
Figure 4:
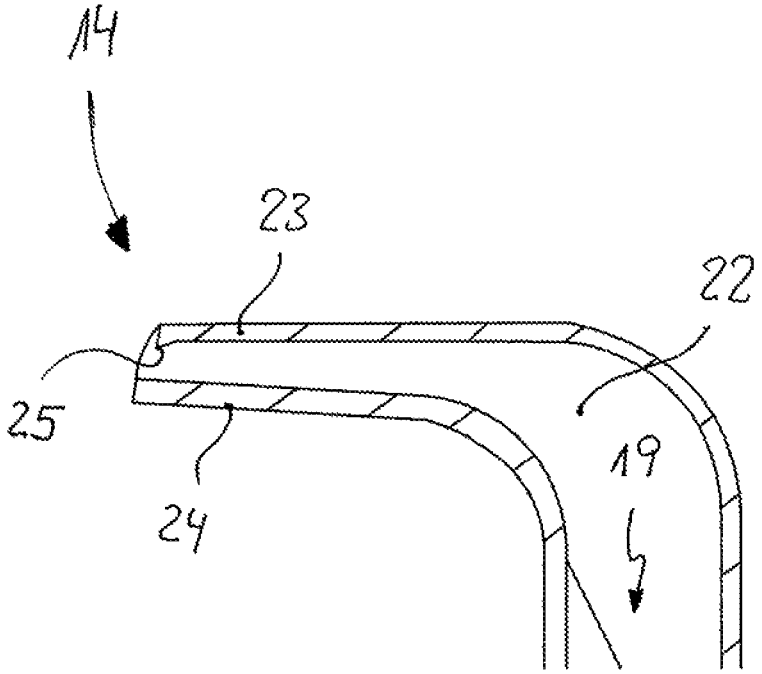
FIG. 4 shows the blow-out opening in an enlarged individual partial view.

By means of its forwardly oriented projection—which in this case is preferably approximately horizontal—the air outlet 14 can be attached to the upper edge of a plinth board or a plinth strip or kick strip. In particular, the air outlet 14 is located with the lower edge of its forwardly oriented projection on the upper edge of the plinth board. In FIG. 2 a plinth board SB is indicated by dotted lines. The vertically extending condensation region 19 is arranged behind the plinth board SB. Irrespective of the height of the plinth board or the plinth strip, the structural unit 15 can be positioned thereon in a manner which is simple and easy to mount, such that it is always ensured that the blow-out opening is arranged above the upper edge of the plinth board and as a result the air can blow freely out of the dishwasher interior. It is thus always avoided that the blow-out path of the air from the blow-out opening 16 of the air outlet 14 is shielded by a plinth board SB placed in front of the structural unit 15.

A particularly advantageous development provides that the blow-out opening 16 is formed as a wide slot of low height, between an upper lip 23 and a lower lip 24, and the lower lip 24 rises steadily from the condensation region to the blow-out opening. Water dripping on the lower lip is then reliably conducted back into the condensation region 19 and the collecting tank 17 and does not drip into the outside space. During idling periods of the household dishwasher 1 the water collected in the channel-shaped collecting tank can condense again.

In particular, the upper lip 23 on its downwardly facing side can have a drip edge 25 which is located above the lower lip 24, i.e. slightly inwardly offset relative to the actual blow-out opening 16, for example by 4 to 8 millimeters. Water from the drip edge 25 then reliably comes into contact with the lower lip 24 and can flow back. To this end, the lower lip 24 can be extended further than the upper lip 23.

In order to permit the removal of air, in particular also humid air, from the dishwasher cavity 2, an air channel 26, in particular several tens of centimeters long, which originates from the dishwasher cavity 2 is arranged upstream of the air outlet 14. This air channel 26 starts high up in the dishwasher cavity 2, in particular at least within the upper 50% of the height H of the dishwasher cavity 2 in one of its walls 13. It is particularly advantageous for the rising water vapor, if the air channel starts in the upper 50%, in particular 30%, of the height of the dishwasher cavity 2, for example in a side wall 13.

In a very advantageous manner, the air channel 26 has a variable length up to the connection at the inlet 20 of the structural unit 15. This is possible, for example, via a folding bellows-type hose. In the depth direction T the arrangement of the structural unit 15 is variable.

A fan wheel or similar conveying member is provided for conveying air from the dishwasher cavity 2 to the air outlet 14. This conveying member can be activated, in particular. Alternatively and particularly effectively, the conveying member is controlled via a moisture sensor system which provides a measurement of the current level of moisture of the items to be washed which are located in the dishwasher cavity.

In both cases, the conveying member is only switched on now and again in order to convey humid air repeatedly out of the dishwasher cavity 2 and thus to preserve the quality of the cleaning of the items to be washed, even over a lengthy time period. Due to the short effective running times, the energy consumption is low—as is the noise emitted by the at least one fan wheel or similar conveying member. The items to be washed can then also be stored over several days in the dishwasher cavity 2.

The risk of condensation at the air outlet 14 is significantly reduced overall by means of the invention. The dew point of the air is also reduced by the condenser 19 arranged upstream thereof.

The invention claimed is:

1. A household dishwasher, comprising:

a dishwasher cavity for treating items to be washed;

a plinth attached to a front side of the household dishwasher in a lower quarter of a height of the household dishwasher; and a structural unit configured to extend over at least half of a width of the household dishwasher, an upper end of said structural unit comprising an air outlet that defines a blow-out opening for blowing air out of the dishwasher cavity, said air outlet extending over the at least half of the width of the household dishwasher and protruding forward over a top edge of the plinth, a lower end of said structural unit comprising a collecting tank for collecting condensate, and said structural unit comprising a condensation region extending substantially perpendicular to the air outlet along a back edge of the plinth, positioned between the air outlet and the collecting tank, and extending over the at least one half of the width of the household dishwasher.

2. The household dishwasher of claim 1, wherein the structural unit further comprises an inlet opening leading into the condensation region at a rear of the structural unit.

3. The household dishwasher of claim 2, wherein the structural unit is configured integrally with the blow-out opening, the inlet opening and the condensation region.

4. The household dishwasher of claim 3, wherein the structural unit is configured in one piece.

5. The household dishwasher of claim 1, wherein the air outlet is at least 40 centimeters wide overall.

6. The household dishwasher of claim 1, wherein the air outlet is configured as a flat slotted outlet with a height-to-width ratio of less than 1:10.

7. The household dishwasher of claim 1, wherein the air outlet has a height-to-width ratio of less than 1:20.

8. The household dishwasher of claim 1, wherein the air outlet is divided into a plurality of partial slots which are aligned adjacent to one another.

9. The household dishwasher of claim 8, wherein two to three of the plurality of partial slots are provided adjacent to one another.

10. The household dishwasher of claim 1, wherein the air outlet is arranged on a user-facing front face of the household dishwasher.

11. The household dishwasher of claim 10, wherein the air outlet is arranged such that the structural unit comprising the air outlet is arranged entirely at a lower end of the front face of the household dishwasher.

12. The household dishwasher of claim 1, wherein the structural unit extends over an entire width of the front face of the household dishwasher.

13. The household dishwasher of claim 10, wherein the structural unit includes a front outer wall delimiting the condensation region, said air outlet protruding forward relative to remaining outer walls of the structural unit toward the front face such that the blow-out opening faces further forward, in particular by several centimeters, than the front outer wall.

14. The household dishwasher of claim 1, wherein the blow-out opening has a uniform height over its width extent.

15. The household dishwasher of claim 1, wherein the blow-out opening is formed between an upper lip and a lower lip of the air outlet, said lower lip configured to rise steadily from the condensation region to the blow-out opening.

16. The household dishwasher of claim 15, wherein the upper lip has a downwardly facing side formed with a drip edge which is located above the lower lip.

17. The household dishwasher of claim 2, further comprising an air channel, in particular several tens of centimeters long, being arranged upstream of the structural unit and connectable in a flexible manner to the inlet opening of the structural unit.

18. The household dishwasher of claim 17, wherein the air channel has a variable length up to a connection to the inlet opening of the structural unit.

19. The household dishwasher of claim 17, further comprising a conveying member for conveying air out of the dishwasher cavity to the air outlet through the air channel.

20. The household dishwasher of claim 19, wherein the conveying member is activatable in a clocked manner, even over a period of several days.

21. The household dishwasher of claim 19, wherein the conveying member is activatable by detecting a level of moisture in the dishwasher cavity.

22. A household dishwasher, comprising:

a dishwasher cavity for receiving items to be washed for treatment;

a plinth attached to a front side of the household dishwasher in a lower quarter of a height of the household dishwasher; and a structural unit comprising an air outlet for blowing air out of the dishwasher cavity, the air outlet on an upper end of the structural unit and extending over at least half of a width of the household dishwasher, a collecting tank for collecting condensate, the collecting tank on a lower end of the structural unit, a condensation region that extends along a back edge of the plinth, is positioned between the air outlet and the collecting tank, and that extends over the at least one half of the width of the household dishwasher, the air outlet defining a blow-out opening, and the air outlet extending substantially perpendicular to the condensation region and protruding forward over a top edge of the plinth toward a front face of the household dishwasher, and an inlet opening leading into the condensation region at a rear of the structural unit.

23. The household dishwasher of claim 22, wherein the structural unit is configured integrally with the blow-out opening, the inlet opening and the condensation region.

24. The household dishwasher of claim 22, wherein the structural unit is configured in one piece.

* * * * *